United States Patent [19]

Leininger et al.

[11] Patent Number: 4,880,063

[45] Date of Patent: Nov. 14, 1989

[54] ADJUSTABLE CONCEALED SPRINKLER

[75] Inventors: Ernest Leininger, Northport, N.Y.; Leonard Blum, Montvale; Gary W. Ponte, West Orange, both of N.J.

[73] Assignee: The Reliable Automatic Sprinkler Co., Inc., Mount Vernon, N.Y.

[21] Appl. No.: 37,469

[22] Filed: Apr. 13, 1987

[51] Int. Cl.[4] ..... A62C 37/08; A62C 37/14

[52] U.S. Cl. ..... 169/37; 169/39

[58] Field of Search ..... 169/37–42, 169/19, 51, 52, 56, 57, 90; 239/505; 137/74

[56] References Cited

U.S. PATENT DOCUMENTS

| | | | |
|---|---|---|---|
| 750,768 | 1/1904 | Hibbard . | |
| 2,389,331 | 11/1945 | Tyden | 169/37 |
| 2,558,450 | 6/1951 | Martin . | |
| 2,759,546 | 8/1956 | Zabriskie | 169/57 X |
| 3,198,258 | 8/1965 | Werner . | |
| 3,389,884 | 6/1968 | Ault . | |
| 3,393,746 | 7/1968 | Hodnett . | |
| 3,459,266 | 8/1969 | Ault | 169/37 |
| 3,633,676 | 1/1972 | Gloeckler | 169/40 |
| 3,714,989 | 2/1973 | Gloeckler | 169/42 X |
| 3,998,273 | 12/1976 | Juliano . | |
| 4,014,388 | 3/1977 | Anderson | 169/42 X |
| 4,015,665 | 4/1977 | Simons et al. | 169/42 X |
| 4,066,129 | 1/1978 | Anderson | 169/37 |
| 4,105,076 | 8/1978 | Simons et al. . | |
| 4,108,247 | 8/1978 | Mohler | 169/38 |
| 4,215,751 | 8/1980 | Mears . | |
| 4,405,018 | 9/1983 | Fischer . | |
| 4,440,234 | 4/1984 | Shea | 169/39 |

FOREIGN PATENT DOCUMENTS

| | | | |
|---|---|---|---|
| 207158 | 9/1966 | Sweden | 169/37 |

*Primary Examiner*—Sherman D. Basinger
*Assistant Examiner*—James M. Kannofsky
*Attorney, Agent, or Firm*—Brumbaugh, Graves, Donohue & Raymond

[57] ABSTRACT

In the particular embodiment of an adjustable concealed sprinkler disclosed in the specification, a center strut sprinkler has a frame with an inlet opening at one end and a cap is normally retained in position over the inlet opening by a thermally responsive strut assembly extending between the cap and the other end of the frame. A deflector is supported by pins having tapered enlarged heads to be received in correspondingly tapered sockets formed in the frame. To retain the deflector in a retracted position and urge the strut assembly away from the cap-retaining position, a wire spring extends from an enlarged head of one of the deflector retaining pins around the strut assembly to engage a portion of the frame.

7 Claims, 2 Drawing Sheets

ADJUSTABLE CONCEALED SPRINKLER

BACKGROUND OF THE INVENTION

This invention relates to automatic fire extinguishing sprinklers, and, more particularly, to a new and improved adjustable concealed sprinkler having a cover and a deflector which are releasable in response to elevated temperature conditions.

Heretofore, certain concealed sprinklers having a releasable cover concealing the sprinkler, such as the sprinklers described in U.S. Pat. Nos. 4,014,388 and 4,066,129, have had a movable deflector which normally presses against the cover. With such arrangements, however, the continuous pressure applied to the cover may tend to cause cold flow of a solder bond which is intended to hold the cover in position until an elevated temperature releases it. In other forms of concealed sprinklers, such as those shown in U.S. Pat. Nos. 2,389,331, 3,459,266, 3,633,676 and 3,714,989, the deflector, as well as a cap or plug sealing the liquid outlet, are held in place by a thermally responsive lever arrangement extending across the sprinkler frame which requires additional space between the deflector and the cover.

Accordingly, it is an object of the present invention to provide a new and improved adjustable concealed sprinkler which overcomes the above-mentioned disadvantages of the prior art.

Another object of the present invention is to provide an adjustable concealed sprinkler having a movable deflector which is effectively retained away from the cover plate until the sprinkler has been actuated by an elevated temperature condition.

A further object of the invention is to provide a new and improved adjustable concealed sprinkler of the center strut type wherein sprinkler actuation is effected more rapidly after an elevated temperature condition has been attained.

An additional object of the invention is to provide an improved adjustable concealed sprinkler having a movable deflector in which the deflector is more securely held when in the extended position.

SUMMARY OF THE INVENTION

These and other objects of the invention are attained by providing a sprinkler having an outlet opening for fire extinguishing liquid, a frame member supporting a releasable strut arrangement holding a cap in position over the outlet opening and responsive to elevated temperatures to release the cap, a deflector slidably supported with respect to the frame by a plurality of guide pins, a spring member extending between one of the guide pins and the releasable strut arrangement so as to normally retain the guide pin and the deflector in a retracted condition and to urge the releasable strut means away from the cap retaining position, a head having a tapered surface on at least one of the guide pins, and a socket supported from the frame member and shaped to receive the tapered pin head in close fitting relation in the extended condition of the deflector so as to retain the extended deflector in a relatively rigid position.

BRIEF DESCRIPTION OF THE DRAWINGS

Further objects and advantages of the invention will be apparent from a reading of the following description of the invention in conjunction with the accompanying drawings in which.

DETAILED DESCRIPTION OF A PREFERRED EMBODIMENT

Figure 1:
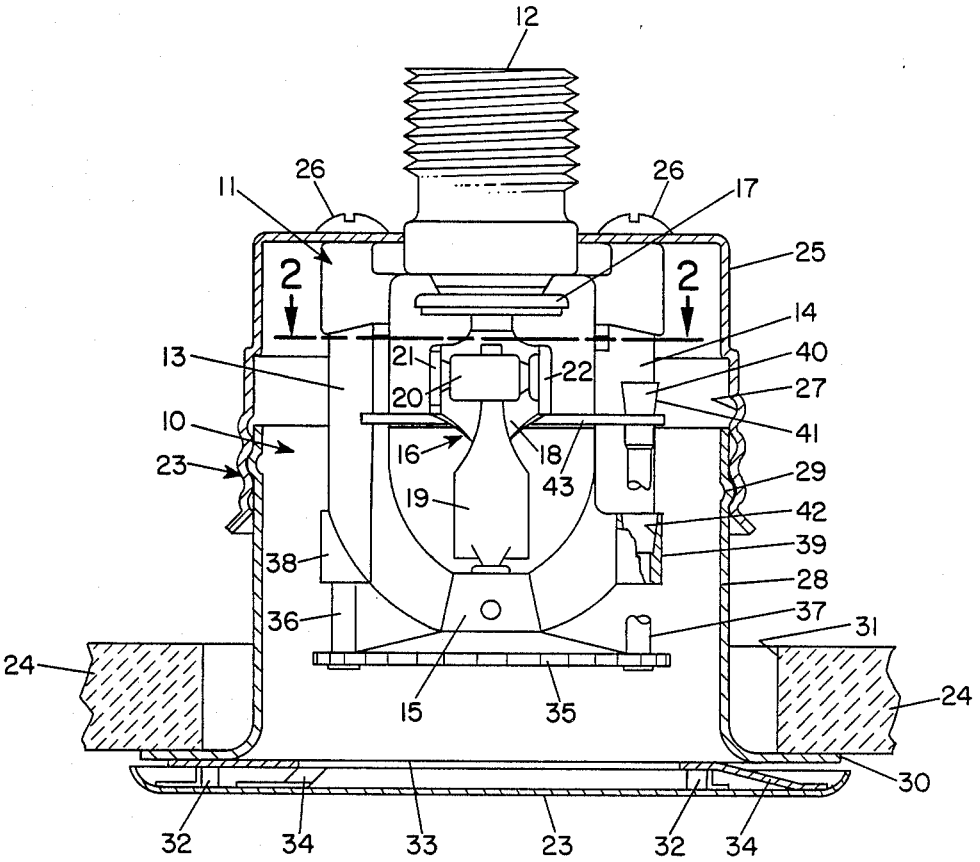
FIG. 1 is a side view, partially in section, illustrating a representative embodiment of an adjustable concealed sprinkler arranged in accordance with the invention in the unactuated condition.

In the representative embodiment of the invention illustrated in the drawings, a center strut-type sprinkler 10 has a frame 11 with a liquid inlet 12 which is externally threaded for attachment to a water supply pipe. The frame 11 includes two parallel arms 13 and 14 joined at the end 15 opposite the inlet 12 and a strut assembly 16 extends between the end 15 of the frame and a cap 17 which closes the liquid opening in the inlet 12 of the sprinkler.

Figure 2:
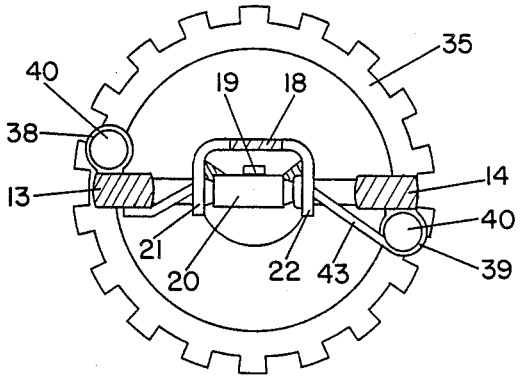
FIG. 2 is a fragmentary sectional view of the sprinkler shown in FIG. 1, taken along the lines 2—2 of FIG. 1 and looking in the direction of the arrows.

The strut assembly 16 is of the type described and illustrated in FIGS. 1 and 2 in the U.S. Pat. No. 4,440,234 to Shea and includes a strut member 18 which at one end engages the cap 17 and at the other end engages a lever member 19 which is supported by the end 15 of the frame. A thermally responsive capsule 20 extends between two arms 21 and 22 of the strut member 18 so as to hold the end of the lever member 19 in position to maintain the strut assembly in the cap-retaining condition shown in FIG. 1. When the temperature exceeds a predetermined value, the solder in the capsule 20 fuses, releasing the capsule from the arms 21 and 22 and permitting the end of the lever 19 to move away from the strut 18 which thereby permits the strut assembly to release the cap 17.

The sprinkler assembly is enclosed in a housing 22 of adjustable length so that a cover 23, which normally conceals the sprinkler, may be positioned adjacent to the lower surface of a ceiling 24 even though the position of the sprinkler 10 may vary with respect to the location of the ceiling 24. To accomplish this, the housing 22 consists of a cup-shaped member 25 held by two screws 26 to the frame 11 and having an internal thread 27 formed at its open end. A tubular extension member 28 is formed at one end with an external thread 29 to cooperate with the thread 27 and terminates at the opposite end in a flange 30 which engages the lower surface of the ceiling 24 surrounding an opening 31 through which the sprinkler may be mounted. The cover plate 23 is releasably attached to the flange 30 by soldered legs 32 and the fusing temperature of the solder by which they are attached is selected so that the cover plate will be released at a temperature at or slightly below the temperature in which the capsule 20 releases the strut assembly. To assist in releasing the cover plate 23 from the flange 30, a spring member 33, which engages the flange 30 and has spring fingers 34 pressing against the cover 23, is interposed between the cover and the flange 30. Because of the threaded connection between tubular extension 28 and the cup-shaped housing 25, the position of the cover 23 with respect to that of the sprinkler 10 can be varied over a substantial range to accomodate different levels of the ceiling 24 with respect to the sprinkler.

Figure 3:
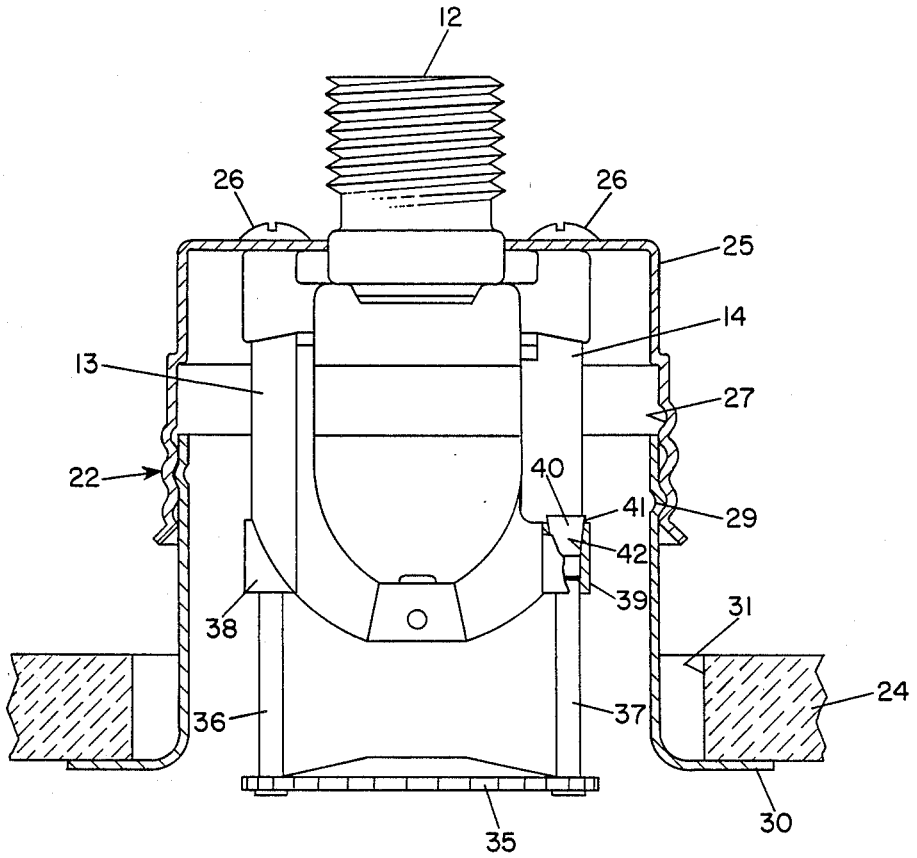
FIG. 3 is a view similar to that of FIG. 1 illustrating the sprinkler in the actuated condition.

In order to assure uniform distribution over a wide area of the water emerging from the inlet 12 when the sprinkler is activated, a deflector 35 is supported for relative motion between a retracted position, illustrated in FIG. 1, and an extended position, illustrated in FIG. 3, by two deflector support pins 36 and 37 which are slidably received in corresponding bosses 38 and 39, respectively, formed at the ends of the frame arms 13 and 14. Each of the deflector support pins 36 and 37 is provided with an enlarged head 40 having a tapered outer surface 41, only one of which is visible in FIG. 1. To receive the tapered surface 41 of the pin head, each of the bosses 38 and 39 is formed with a correspondingly tapered inner surface 42 to form a close fitting socket for the head 40 when the deflector is in the extended position, as shown in FIG. 3. As a result of this close fit relation between the pins 36 and 37 and the sockets in the bosses 38 and 39, the deflector 35 is properly oriented and stabilized to provide improved distribution of the stream of water emerging from the inlet 12 after the sprinkler has been actuated.

In order to retain the deflector 35 in a retracted condition prior to actuation without any engagement of the deflector with the cover member 23, while at the same time providing an urging force promoting rapid separation of the strut assembly 16 from the frame upon actuation, a generally V-shaped spring member 43 is positioned, as best seen in FIG. 2, so that one end engages the smaller end of the tapered surface 41 of the enlarged head 40 of one of the deflector support pins 37 the center portion extends behind the strut member 18, while the other end engages the front of the frame arm 13. The spring tension thus retains the deflector pin 37, along with the deflector 35, in the retracted condition and urges the strut assembly laterally with respect to the frame so that, when the capsule 20 is fused, the strut 18 and lever 19 are rapidly ejected from the frame, permitting the cap 17 to release water from the inlet 12 immediately.

In operation, when the temperature in a vicinity of the concealed sprinkler reaches a selected level, such as 160° F., the solder by which the support members 32 are attached to the flange 30 fuses and the spring fingers 34 force the cover plate away from the sprinkler. The capsule 28 will also fuse at the same time or promptly thereafter, permitting the spring 43 to eject the strut assembly 16 from the frame so that the cap 17 is immediately released from inlet 12, causing water to emerge in the downward direction as viewed in FIG. 1. The emerging water promptly forces the deflector 35 to the extended position shown in FIG. 3 and, since that position is below the level of the flange 30 even when the tubular member 28 is in its lowermost position with respect to the cup-shaped member 25 of the housing 22, the emerging water will be uniformly dispersed over a wide area beneath the sprinkler. Moreover, because the enlarged heads 40 of the support pins 37 fit closely in the tapered sockets 42, the pins 36 and 37 hold the deflector rigidly in position, preventing variations in the orientation or lateral position of the deflector despite the force of the water directed at the deflector from the inlet 12.

Although the invention has been described herein with reference to a specific embodiment, many modifications and variations therein will readily occur to those skilled in the art. Accordingly, all such variations and modifications are included within the intended scope of the invention as defined by the following claims.

We claim:

1. A sprinkler for use in a fire extinguishing system comprising frame means having an inlet opening for fire extinguishing liquid and spaced arms extending from the inlet opening to provide a support at a location spaced from the inlet opening, a cap normally covering the inlet opening, thermally responsive strut means extending between the support and the cap and normally retaining the cap in position over the inlet opening, deflector means slidably supported from the frame means by a plurality of pins having heads with tapered surfaces, tapered socket means associated with the frame means to receive the tapered surfaces of the pin heads in close fitting relationship when the deflector is in the extended position, and spring means engaging one of the pin heads and the strut means to normally retain the deflector means in retracted condition while urging the strut means in a direction away from the frame means.

2. A sprinkler according to claim 1 including adjustable housing means for the sprinkler comprising a cup-shaped member affixed to the frame means and having a threaded portion, a tubular extension having a threaded portion adjacent to one end adapted to cooperate with the threaded portion of the cup-shaped member and cover means releasably retained at the opposite end by thermally responsive means, and spring means urging the cover means away from the tubular extension.

3. A sprinkler for use in a fire extinguishing system comprising frame means formed at one end with an inlet opening for fire extinguishing liquid, a deflector having an axis supported from the frame means by a plurality of support pins for motion in an axial direction between retracted and extended positions, each of the support pins being laterally spaced from the axis of the deflector and having a head with a tapered outer surface, and a corresponding plurality of sockets associated with the frame means, the sockets being formed with tapered inner surfaces to receive the heads of the support pins and thereby maintain the deflector means in place when in the extended position.

4. A sprinkler for use in a fire extinguishing system comprising frame means formed at one end with an inlet opening for fire extinguishing liquid, a deflector supported from the frame means by a plurality of support pins for motion between retracted and extended positions, each of the support pins having a head with a tapered outer surface, a corresponding plurality of sockets associated with the frame means, the sockets being formed with tapered inner surfaces to receive the heads of the support pins and thereby maintain the deflector means in place when in the extended position, and spring means engaging at least one of the support pins to normally retain the deflector in the retracted position but releasable from the support pin upon actuation of the sprinkler to permit the deflector to move to the extended position.

5. A sprinkler according to claim 4 including cap means normally covering the inlet opening and thermally responsive strut means normally retaining the cap in position over the inlet opening, wherein the spring means normally engages the strut means so that when the strut means is released by thermal actuation the spring means releases the deflector support pin.

6. In a sprinkler having an inlet opening, blocking means normally blocking the inlet opening, thermally responsive retaining means for retaining the blocking means in blocking position with respect to the inlet opening and deflector means slidably supported for movement between retracted and extended positions, spring means normally engaging the thermally responsive retaining means for normally retaining the deflector means in retracted condition and releasing the deflector means for movement to the extended condition upon actuation of the thermally responsive retaining means.

7. In a sprinkler having deflector means with an axis supported by a plurality of support pins for sliding motion in an axial direction between a retracted position and an extended position, the support pins being laterally spaced from the axis of the deflector means, tapered head means on each of the plurality of deflector support pins, and socket means supporting the support pins for sliding motion and having tapered internal surfaces to receive the tapered head means in close fitting relation and thereby support the deflector means in laterally fixed position when the deflector means is in the extended position.

* * * * *